US005425142A

United States Patent [19]

Scott

[11] Patent Number: 5,425,142

[45] Date of Patent: Jun. 20, 1995

[54] BASEBALL GLOVE HAVING A GAUGE PLATE AND AN AROMATIC POLYAMIDE

[76] Inventor: Daniel M. Scott, 722 E. Mesquite Ave., Apache Junction, Ariz. 85219

[21] Appl. No.: 75,609

[22] Filed: Jun. 14, 1993

[51] Int. Cl.[6] ..... A41D 13/08

[52] U.S. Cl. ..... 2/19; 2/160; 2/161.1

[58] Field of Search ..... 2/16, 160, 19, 20, 21, 2/161.1, 161.6, 164, 167; 36/71; 273/25, 323

[56] References Cited

U.S. PATENT DOCUMENTS 4,511,148 4/1985 Amos et al. ..... 273/326
4,630,318 12/1986 Aoki ..... 2/19
4,748,690 6/1988 Webster ..... 2/19
4,864,661 9/1989 Gimbel ..... 2/167
5,113,530 5/1992 Smith ..... 2/19
5,113,599 5/1992 Cohen et al. ..... 36/71
5,155,864 10/1992 Walker et al. ..... 2/19
5,159,717 11/1992 Drew et al. ..... 2/19
5,285,529 2/1994 Arena ..... 2/164

*Primary Examiner*—Clifford D. Crowder
*Assistant Examiner*—Larry O. Norrell, Jr.

[57] ABSTRACT

A baseball glove includes spaced front and back rear walls having a glove cavity therewithin, wherein the front wall includes a liner of an impenetrable material typically employing Kevlar.

1 Claim, 4 Drawing Sheets

BASEBALL GLOVE HAVING A GAUGE PLATE AND AN AROMATIC POLYAMIDE

BACKGROUND OF THE INVENTION

1. Field of the Invention

The field of invention relates to baseball glove apparatus, and more particularly pertains to a new and improved baseball glove wherein the same is arranged to minimize discomfort and pain in use of the structure.

2. Description of the Prior Art

Baseball gloves of various types have been utilized in the prior art and exemplified by the U.S. Pat. 4,891,845; 4,987,611; 5,031,239; and 3,898,696.

The instant invention attempts to overcome deficiencies of the prior art by employing a baseball glove having a front wall, including an aromatic polyamide liner to dissipate impact in use of the structure and in this respect, the present invention substantially fulfills this need.

SUMMARY OF THE INVENTION

In view of the foregoing disadvantages inherent in the known types of baseball glove apparatus now present in the prior art, the present invention provides a baseball glove wherein the same includes an aromatic polyamide liner. As such, the general purpose of the present invention, which will be described subsequently in greater detail, is to provide a new and improved baseball glove which has all the advantages of the prior art baseball glove apparatus and none of the disadvantages.

To attain this, the present invention provides a baseball glove including spaced front and back rear walls having a glove cavity therewithin, wherein the front wall includes a liner of an impenetrable material typically employing Kevlar (TM).

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved baseball glove which has all the advantages of the prior art baseball glove apparatus and none of the disadvantages.

It is another object of the present invention to provide a new and improved baseball glove which may be easily and efficiently manufactured and marketed.

It is a further object of the present invention to provide a new and improved baseball glove which is of a durable and reliable construction.

An even further object of the present invention is to provide a new and improved baseball glove which is susceptible of a low cost of manufacture with regard to both materials and labor, and which accordingly is then susceptible of low prices of sale to the consuming public, thereby making such baseball gloves economically available to the buying public.

Still yet another object of the present invention is to provide a new and improved baseball glove which provides in the apparatuses and methods of the prior art some of the advantages -thereof, while simultaneously overcoming some of the disadvantages normally associated therewith.

these together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
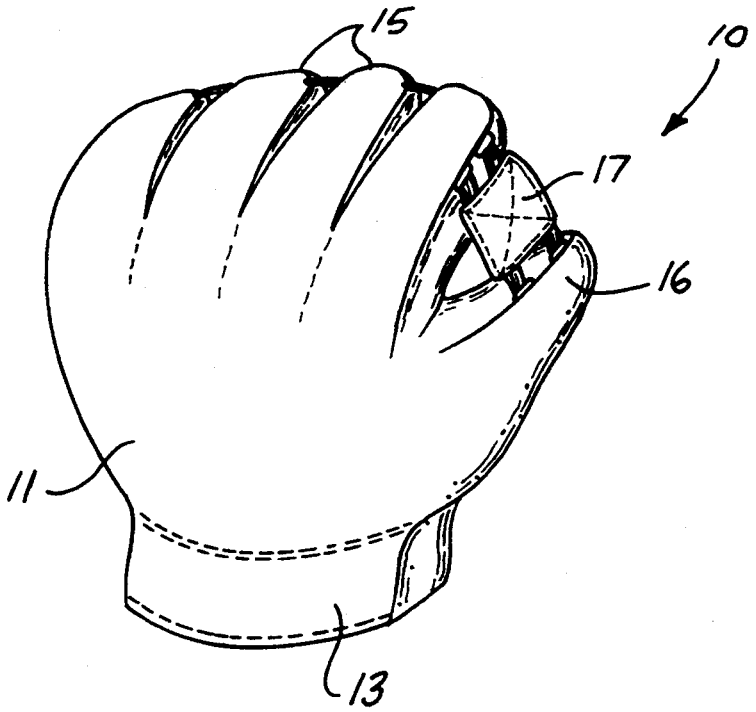
FIG. 1 is an isometric illustration of the invention.
Figure 2:
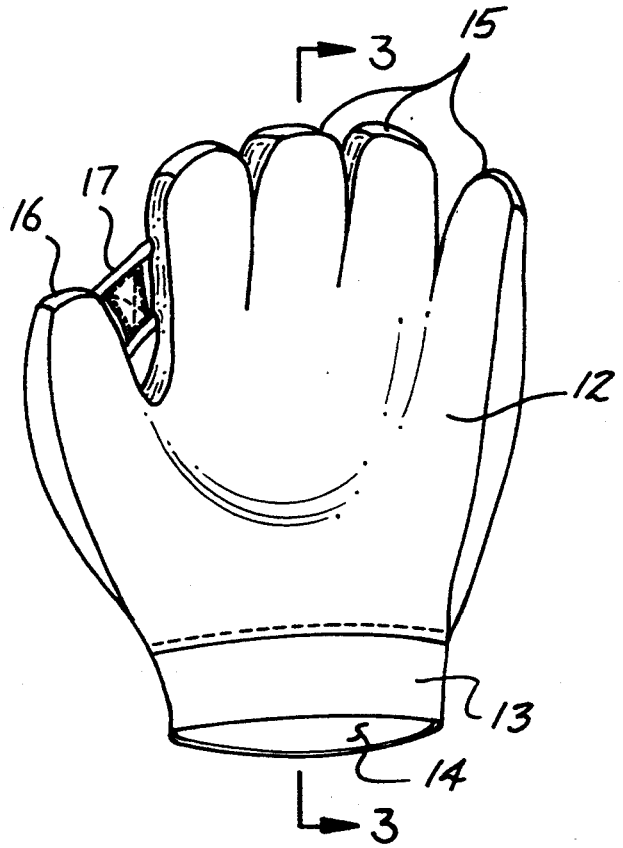
FIG. 2 is an isometric frontal view of the invention.
Figure 3:
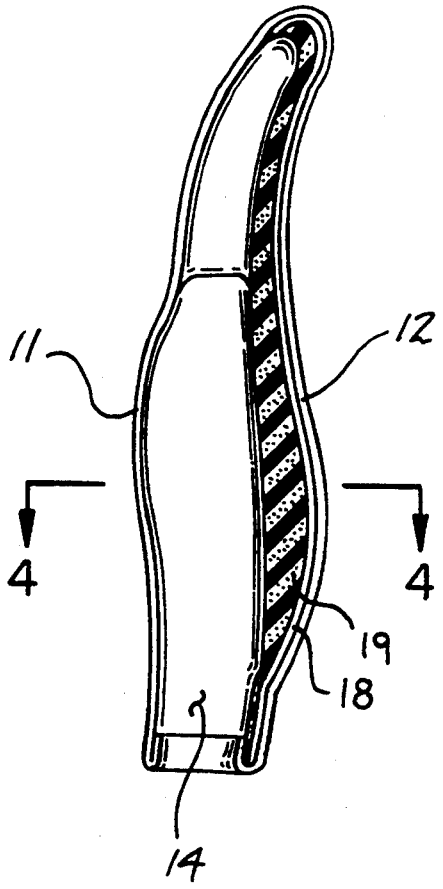
FIG. 3 is an orthographic view taken along the lines 3—3 of FIG. 2 in the direction indicated by the arrows.
Figure 4:
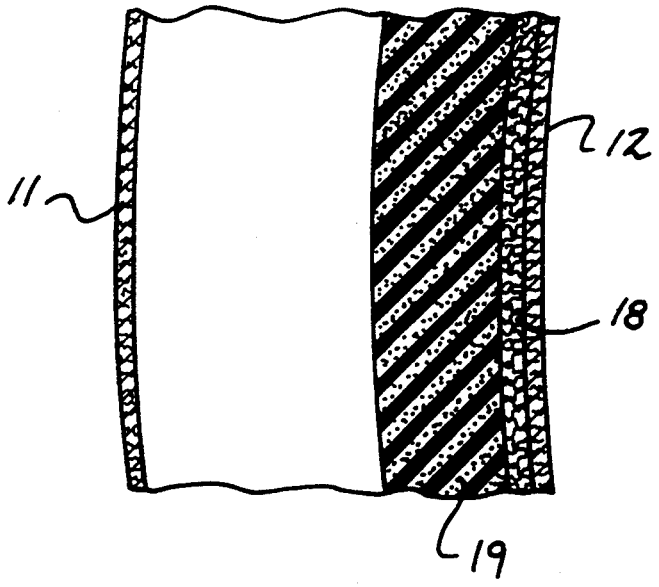
FIG. 4 is an orthographic view, taken along the lines 4—4 of FIG. 3 in the direction indicated by the arrows.

With reference now to the drawings, and in particular to FIGS. 1 to 8 thereof, a new and improved baseball glove embodying the principles and concepts of the present invention and generally designated by the reference numeral 10 will be described.

More specifically, the baseball glove 10 of the instant invention essentially comprises a back wall 11 and a front wall 12, with the back and front wails terminating in a wrist receiving tube 13 at the lowermost end of the glove permitting reception of an individual's hand within the glove cavity 14. Finger sockets 15 extend from the front and back walls 12 and 11 respectively, including a thumb socket 16, with a thumb web 17 securing the thumb socket 16 to an adjacent of the finger sockets 15. Within the cavity 14 and coextensive with the front wall 12 and the coextensive portions of the finger and thumb sockets 15 and 16, is an aromatic polyamide 18 liner to dissipate and distribute impact directed onto the front wall 12. Coextensive with the Kevlar (TM) liner is a resilient polymeric sponge web 19.

Figure 5:
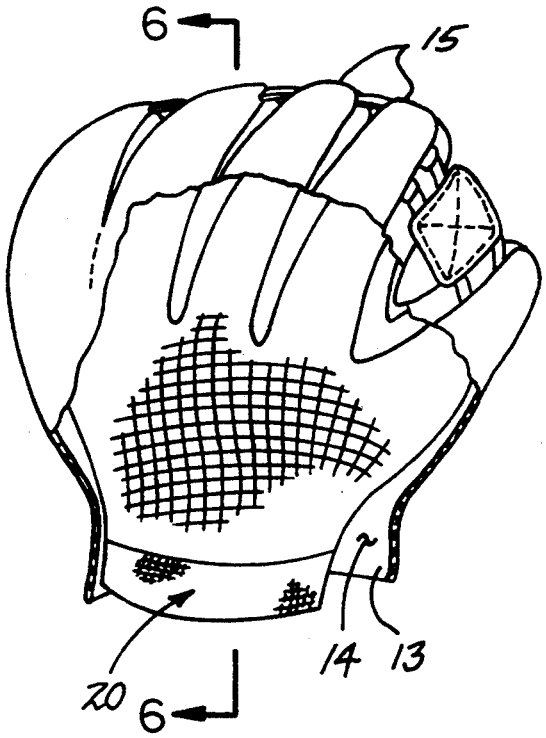
FIG. 5 is an isometric illustration of the invention employing a glove insert.
Figure 6:
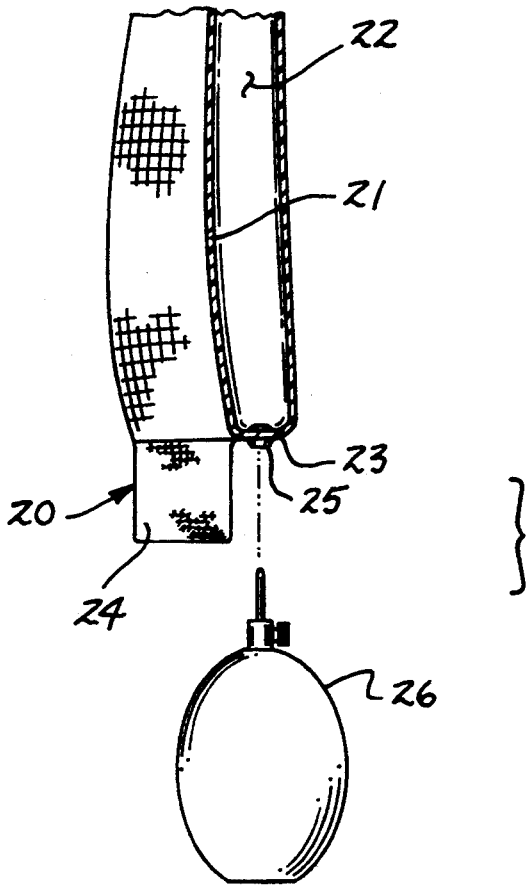
FIG. 6 is an partial orthographic view, taken along the lines 6—6 of FIG. 5 in the direction indicated by the arrows.

The FIGS. 5 and 6 indicates the optional employment of a glove insert 20 to complementarily be received within the glove cavity 14 and the associated finger and thumb sockets, such that a glove insert 20 includes a glove insert front wall 21 having a pneumatic chamber 22 coextensive therewith. The pneumatic chamber 22 includes a pneumatic chamber bottom wall 23 adjacent the insert receiving tube 24 at a lowermost end of the insert that is arranged for coextensive orientation within the wrist receiving tube 13. An inflation bulb 26 is provided to effect selective inflation of the pneumatic chamber 22.

Figure 7:
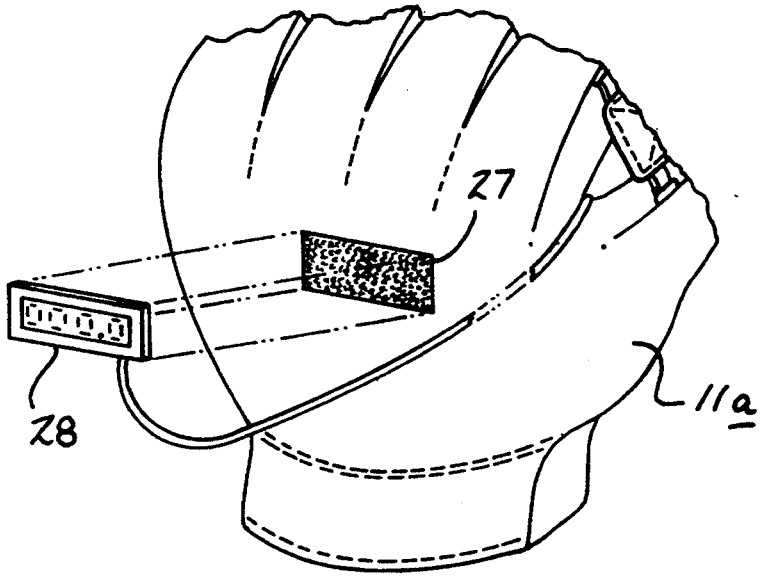
FIG. 7 is an isometric illustration of a modified rear wall structure of the invention.
Figure 8:
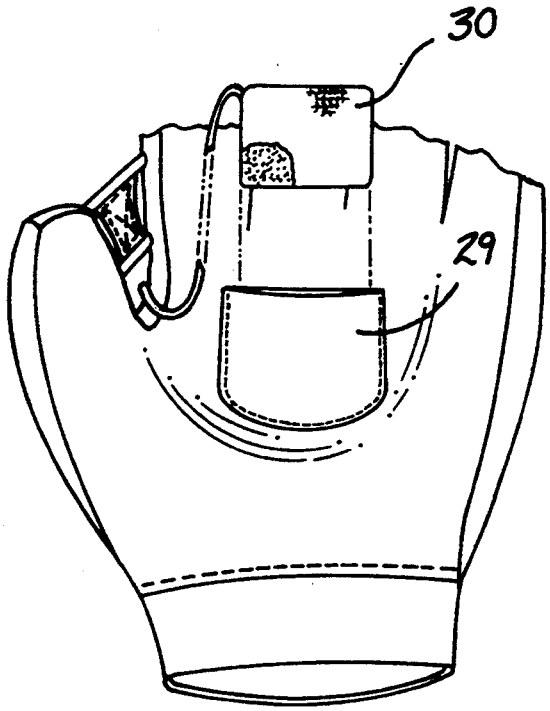
FIG. 8 is an isometric frontal view including a modified frontal wall structure.

The FIGS. 7 and 8 indicates the use of a modified back wall 11*a* having a hook and loop fastener patch 27 to secure a gauge plate 28 to measure impact onto the front wall 12. To this end, the front wall 12 is of a modified construction, having a front wall pocket 29 to receive an impact plate 30 to function as a straining gauge type structure to direct a signal to the gauge plate 28*a* through an interconnecting cable, as illustrated.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, failing within the scope of the invention.

What is claimed as being new and desired to be protected by LETTERS PATENT of the United States is as follows:

1. A baseball glove, comprising, a back wall spaced from a front wall, the baseball glove further including a lowermost end having a wrist receiving tube directed into the back wall and the front wall, with the back wall and front wall having a back wall uppermost end and a front wall uppermost end, including finger sockets directed therealong, with a glove cavity directed into the wrist receiving bore between the front wall, the back wall, and received within the finger sockets, and the front wall including an impact receiving liner coextensive with the front wall, and the back wall includes a gauge plate removably mounted relative to the back wall, and the front wall having a front wall pocket, the front wall pocket including an impact plate, a cable arranged for interconnecting communication of the gauge plate and the impact plate, with the impact plate positioned within the front wall pocket.

* * * * *